US005501507A

United States Patent [19]

Hummitzsch

[11] Patent Number: 5,501,507

[45] Date of Patent: Mar. 26, 1996

[54] SEAT WITH SPRING-LOADED LUMBAR SUPPORT

[76] Inventor: Karl Hummitzsch, 27-225 Benjamin Rd., Waterloo, Ontario, Canada, N2V 1Z3

[21] Appl. No.: 305,945

[22] Filed: Sep. 12, 1994

[51] Int. Cl.[6] ..... A47C 7/14

[52] U.S. Cl. ..... 297/284.4; 297/296; 297/301.5

[58] Field of Search ..... 297/284.1, 284.3, 297/284.4, 306, 300, 285, 354.1, 284.8, 296, 297, 301.1, 301.5, 353, 383

[56] References Cited

U.S. PATENT DOCUMENTS

| | | | |
|---|---|---|---|
| 1,182,854 | 5/1916 | Poler | 297/284.4 |
| 3,121,592 | 2/1964 | Anderson | 297/284.1 |
| 3,241,879 | 3/1966 | Castello et al. | 297/284.4 |
| 4,162,807 | 7/1979 | Yoshimura | 297/284.4 |
| 4,981,325 | 1/1991 | Zacharkow | 297/284.1 |

*Primary Examiner*—Milton Nelson, Jr.
*Attorney, Agent, or Firm*—R. Craig Armstrong

[57] ABSTRACT

The chair has a lumbar support area which moves to follow the fore and aft movements of a person in the chair. The seat back includes two portions, namely an upper portion which is generally fixed in position relative to the seat assembly at any given point in time, and which is positioned so as to contact the upper back area of a person sitting in the chair, and a lumbar portion which is movable forwardly and rearwardly relative to the seat assembly and the upper portion. The lumbar portion is spring-biased forwardly from a position of general alignment with the upper portion, so that it follows the person's back as the person leans forward. Preferably, forward and rear stops are provided to limit the lumbar portion to movement between a rearward position in general alignment with the upper portion and a forward position which is at least somewhat rearward from the forward edge of the seat.

4 Claims, 5 Drawing Sheets

SEAT WITH SPRING-LOADED LUMBAR SUPPORT

BACKGROUND OF THE INVENTION

1. Field of the Invention

This invention relates to chairs, and particularly to a chair having a lumbar support area which moves to follow the fore and aft movements of a person in the chair.

2. Description of the Prior Art

With the introduction of the computer and the ergonomic problems it poses, many seating manufacturers have developed good back rest supports and shapes. Some designs include complicated mechanisms to change the back rest position to give the human back proper support.

Collectively, however, these designs tend to have certain common shortfalls. First of all, when the person is in a task position, he or she is usually leaning forward, away from the support of the back rest. Secondly, people do not understand the typical lever mechanisms, or become weary of the awkwardness of activating the levers, and therefore do not use them. Finally, although the term "passive ergonomic chair" has been bandied about, it is more of a promotional phrase for marketing purposes than something of substance in existing seating products. Because a chair has to be engineered to support the heaviest person who might use it, most "passive" ergonomic chairs are too stiff to live up to their advertised performance for the typical user.

SUMMARY OF THE INVENTION

It is an object of the invention to provide a chair of relatively simple construction which nevertheless provides excellent support for a person's lumbar region throughout the person's normal range of forward and rearward movement in the chair. The simplicity of the concept of the invention may seem out of step with the highly complex ergonomic chairs offered in the market today, but its effectiveness is undeniable.

In the invention, the chair has a seat back which includes two portions, namely an upper portion which is generally fixed in position relative to the seat assembly at any given point in time, and which is positioned so as to contact the upper back area of a person sitting in the chair, and a lumbar portion which is movable forwardly and rearwardly relative to the seat assembly and the upper portion. Spring means bias the lumbar portion forwardly from a position of general alignment with the upper portion, so that it follows the person's back as the person leans forward.

Preferably, forward and rear stops are provided to limit the lumbar portion to movement between a rearward position in general alignment with the upper portion and a forward position which is at least somewhat rearward from the forward edge of the seat.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1:
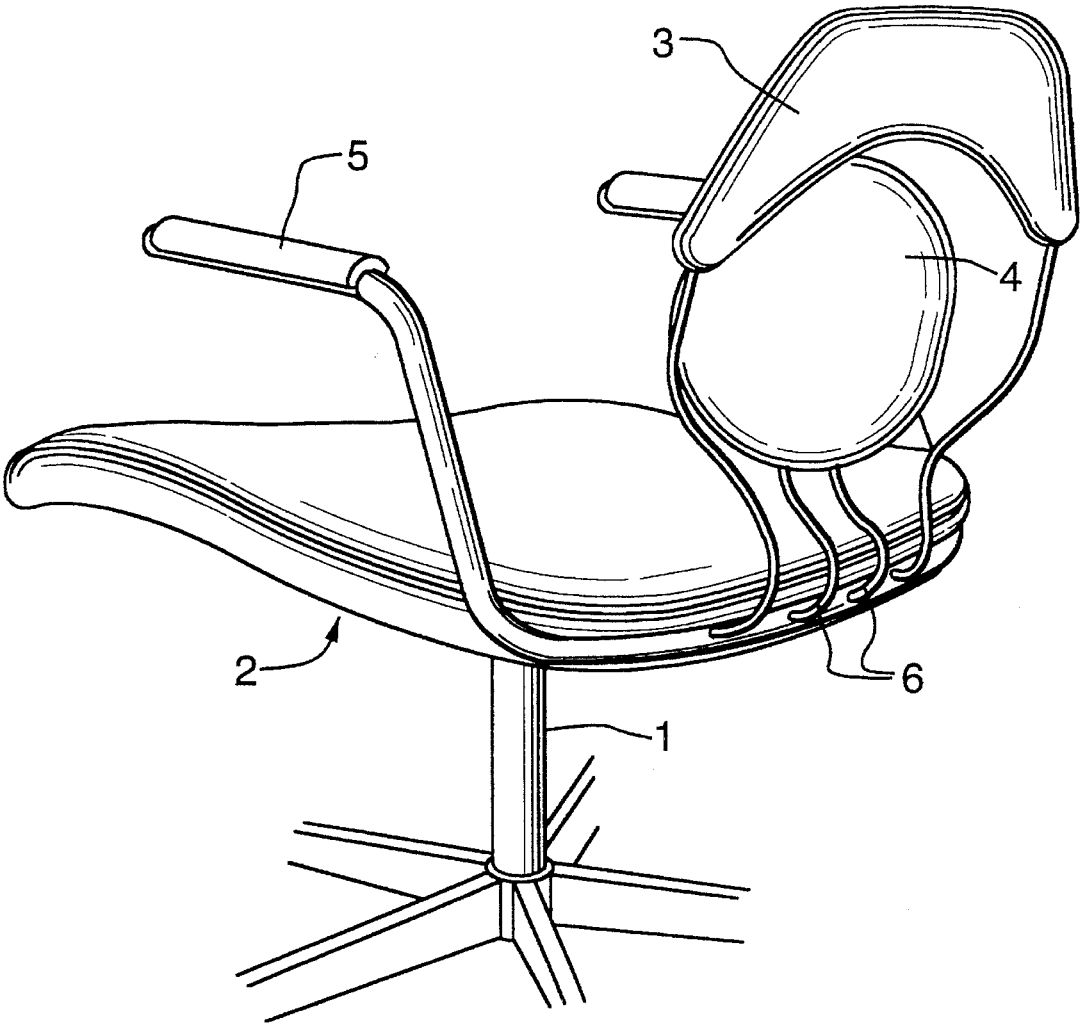
FIG. 1 is a rear-quarter perspective of an exemplary embodiment of the invention.
Figure 2:
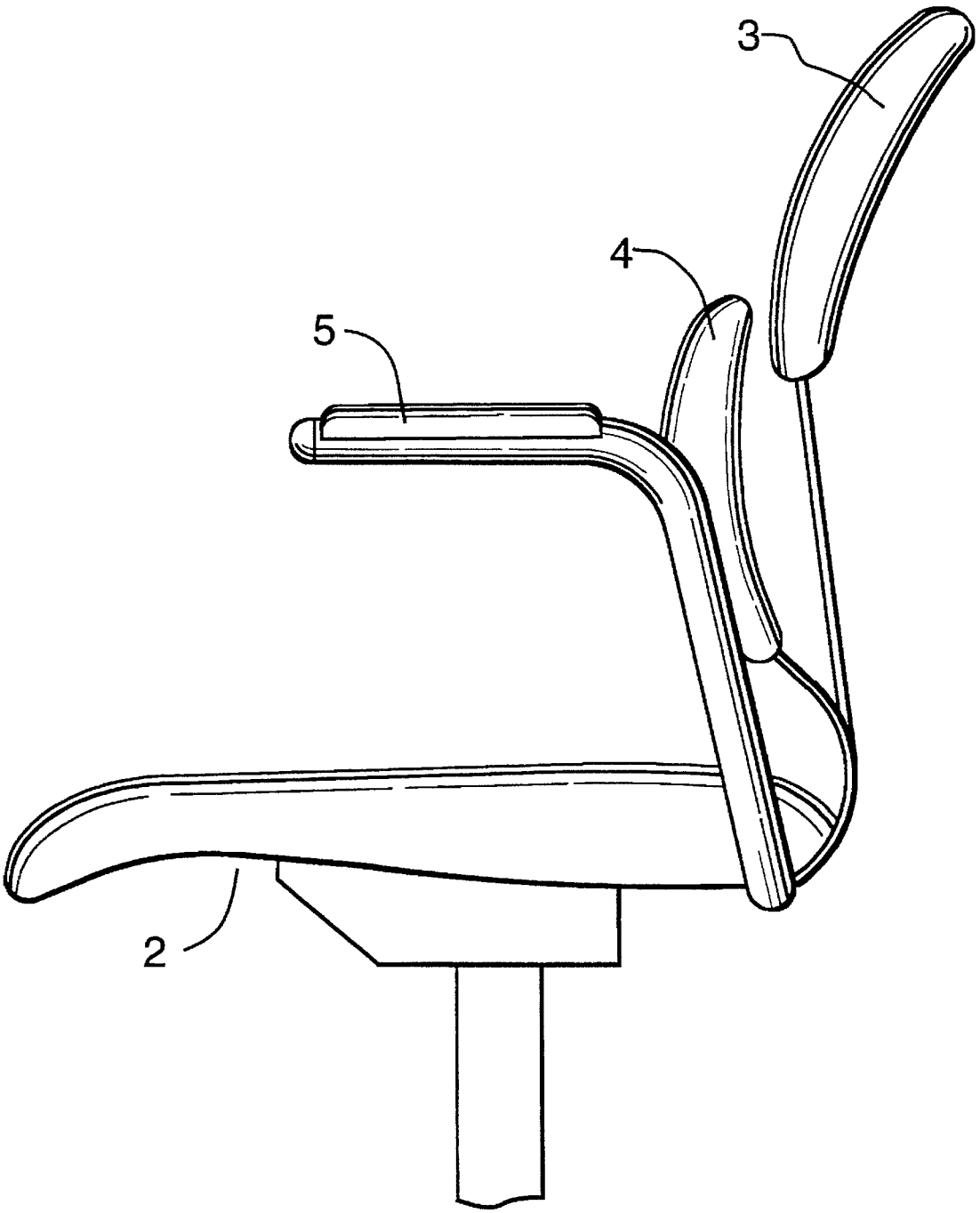
FIG. 2 is a side view of the chair of FIG. 1.
Figure 3:
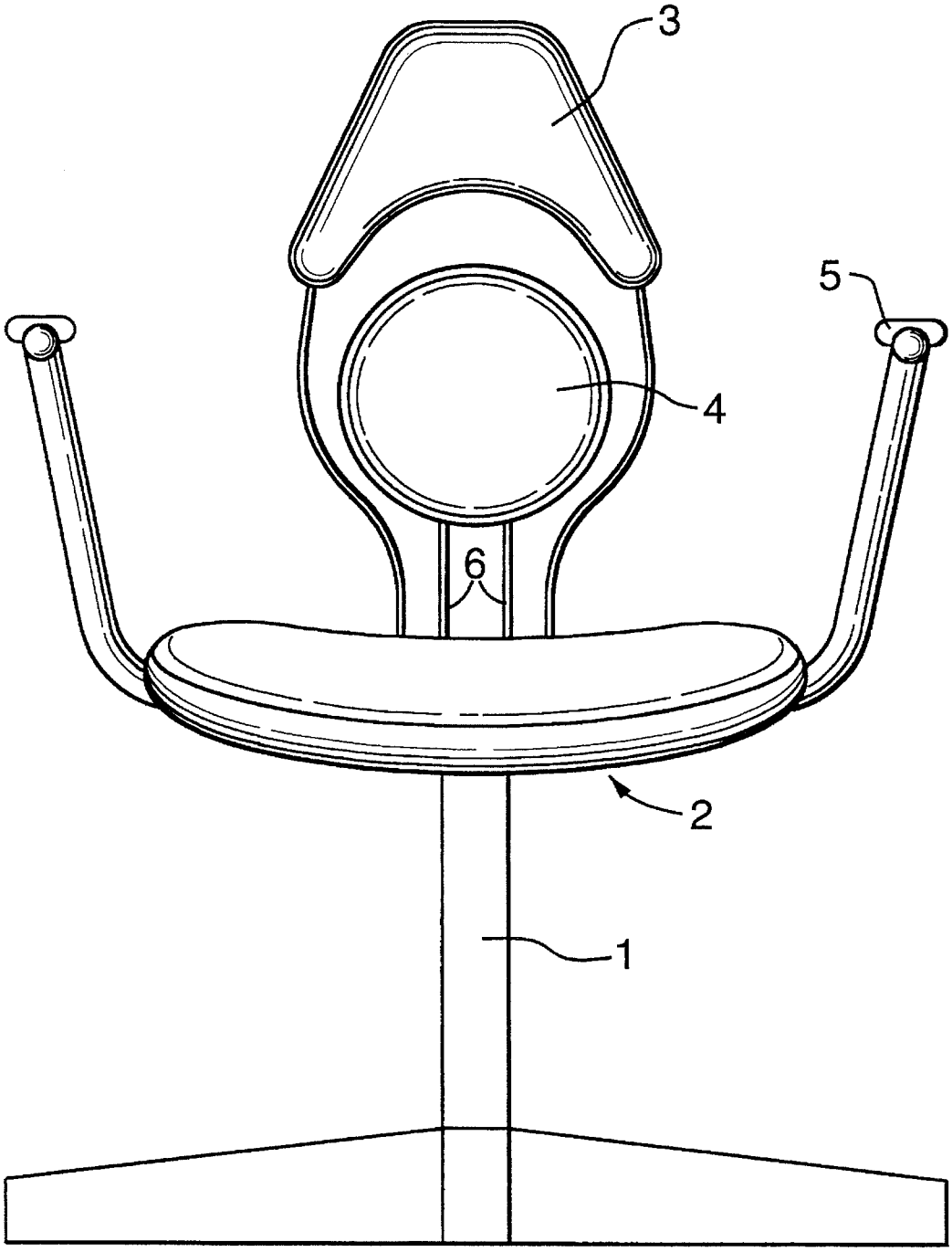
FIG. 3 is a front view of the chair of FIG. 1.

FIGS. 1–3 show a simple example of the invention, in which there is a chair base 1 supporting a seat assembly 2, and a seat back including two portions, namely an upper portion 3 positioned so as to contact the upper back area of a person sitting in the chair, and a lumbar portion 4 which is movable forwardly and rearwardly relative to the seat assembly and the upper portion. Preferably, there are two arms 5, but they are not essential to the invention.

The upper portion 3 may have any desired shape and structure, and may be solid or padded and upholstered as desired. The upper portion may be mounted to the base or to the seat assembly in any desired way, whether fixed or adjustable. In any case, it is intended that the upper portion, although potentially adjustable, will be generally fixed in position relative to the seat assembly at any given point in time, although it may have limited "give" or flex as in many conventional chairs. The upper portion may also have downwardly-extending side portions (not illustrated), positioned laterally outward from the lumbar portion.

The lumbar portion 4 may be mounted in any desired fashion to the base or to the seat assembly, and any desired spring means may be used to bias the lumbar portion forwardly from a position of general alignment with the upper portion, so that it follows the person's back as the person leans forward. A coil spring could be employed, for example, or spring steel rods 6 as illustrated.

Preferably, the spring should be arranged so that the spring force does not vary too much between the forward and rear positions of the lumbar portion. Near the forward position, there should be enough force to exert and maintain pressure on the person's lumbar region, but that force should not increase significantly as the person leans back, so that it is not difficult to lean back in the chair. Ideally, the spring should be arranged so that the spring force is nearly constant throughout the travel of the lumbar portion.

Figure 4:
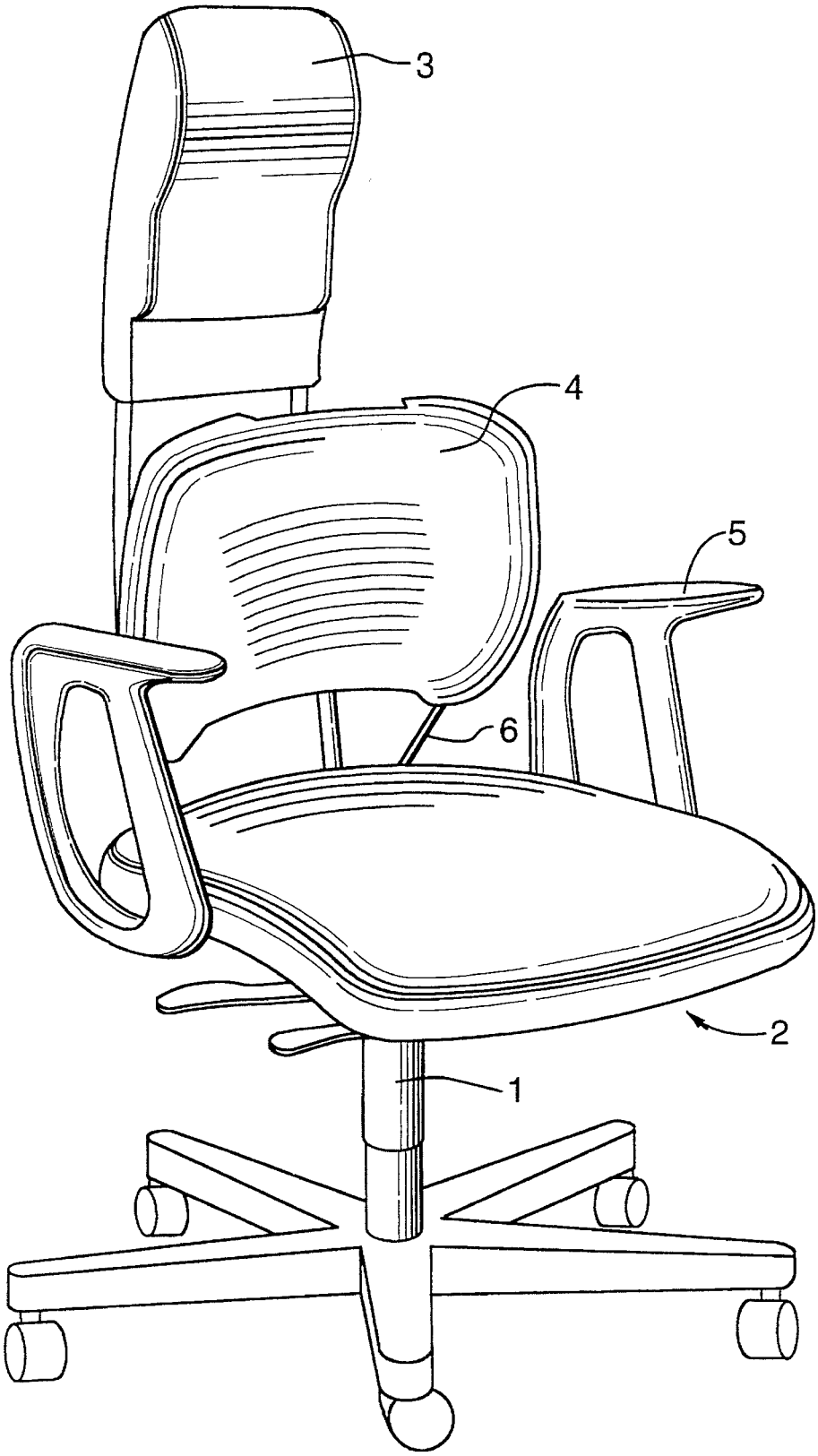
FIG. 4 is a front-quarter perspective of a somewhat more exotic example of the invention.
Figure 7:
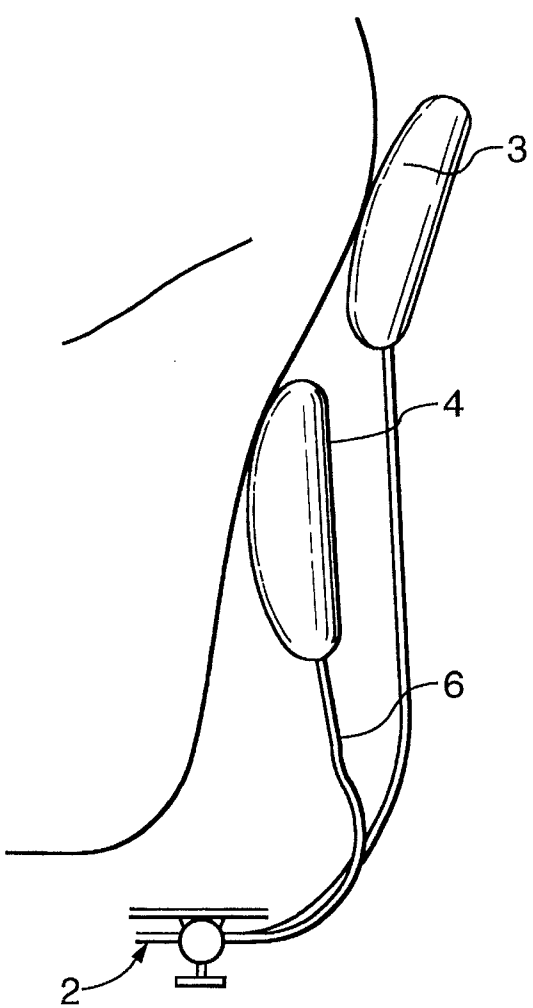
FIG. 7 is a side view similar to FIGS. 5 and 6, but showing a person slouching.
Figure 6:
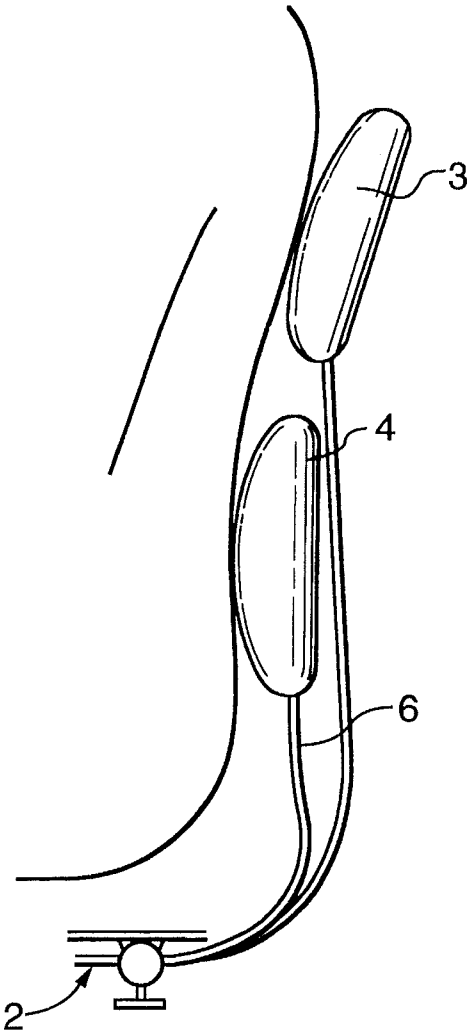
FIG. 6 is a side view similar to FIG. 5, but showing the person leaning back.
Figure 5:
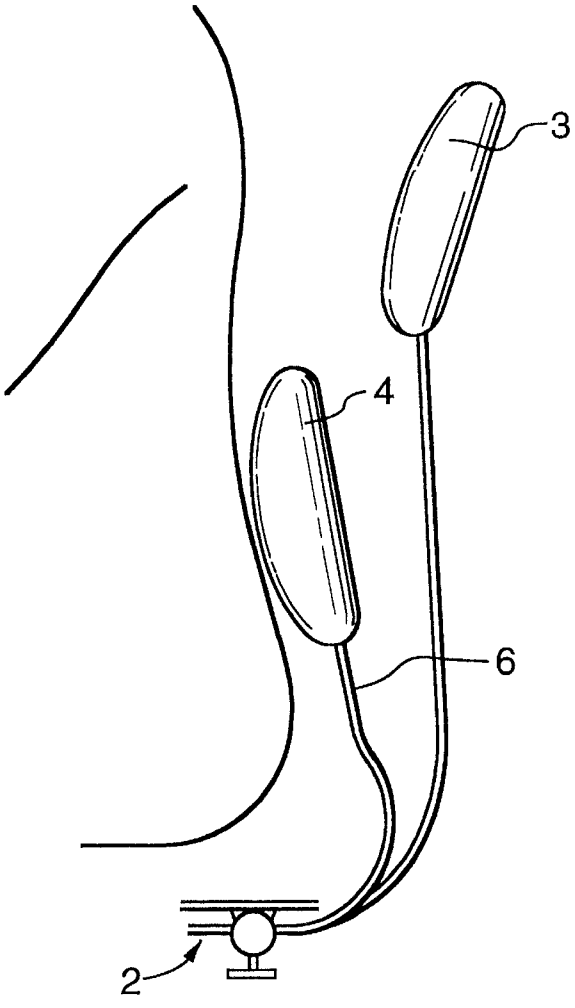
FIG. 5 is a side view of a typical chair, showing a person leaning forward.

Preferably, forward and rear stops are provided to limit the lumbar portion to movement between a rearward position in general alignment with the upper portion and a forward position which is at least somewhat rearward from the forward edge of the seat. Thus in FIG. 4, for example, it can be noted that the upper portion acts as a stop for the lumbar portion.

It will be appreciated that the above description relates to the preferred embodiment by way of example only. Many variations on the invention will be obvious to those knowledgeable in the field, and such obvious variations are within the scope of the invention as described and claimed, whether or not expressly described.

For example, it should be apparent that the spring to bias the lumbar portion need not act between the seat assembly and the lumbar portion; it could act between the upper portion and the lumbar portion.

What is claimed as the invention is:

1. A chair comprising:

a base;

a seat assembly supported above the base;

an upper seat back secured to at least one of said base and said seat assembly, said seat back being generally fixed in position relative to the seat assembly at any given point in time, and which is positioned so as to contact the upper back area of a person when sitting in the chair;

a lumbar support secured to at least one of said base and said seat assembly independently of said upper seat back, said lumbar support being positioned so as to contact the lumbar area of a person when sitting in the chair; and biasing means for continuously urging said lumbar support forwardly from a position of general alignment with said upper seat back such that said lumbar support is automatically maintained against and in general alignment with the lumbar area of the person when the person leans forward in the chair.

2. A chair as recited in claim 1, where said biasing means comprises a spring support between said seat assembly and said lumbar support.

3. A chair as recited in claim 2, further comprising stop means positioned to limit rearward travel of said lumbar support, once said lumbar support is in general alignment with said upper seat back.

4. A chair as recited in claim 3, where said stop means is said upper seat back.

* * * * *